US010562555B2

(12) United States Patent
Fries et al.

(10) Patent No.: US 10,562,555 B2
(45) Date of Patent: Feb. 18, 2020

(54) METHOD FOR CONTROLLING A LEVEL CROSSING AND RAILWAY INSTALLATION FOR IMPLEMENTING SUCH METHOD

(71) Applicant: ALSTOM TRANSPORT TECHNOLOGIES, Saint-Ouen (FR)

(72) Inventors: Jeffrey Fries, Grain Valley, MO (US); Chris Schuchmann, Melbourne, FL (US); William Shields, Grain Valley, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 381 days.

(21) Appl. No.: 15/466,134

(22) Filed: Mar. 22, 2017

(65) Prior Publication Data

US 2018/0273068 A1 Sep. 27, 2018

(51) Int. Cl.

| | |
|---|---|
| ***B61L 29/22*** | (2006.01) |
| ***B61L 29/32*** | (2006.01) |
| ***B61L 23/00*** | (2006.01) |

(52) U.S. Cl.

CPC ..... *B61L 29/22* (2013.01); *B61L 23/002* (2013.01); *B61L 29/32* (2013.01)

(58) Field of Classification Search

CPC ..... B61L 29/00; B61L 29/02; B61L 29/08; B61L 29/16; B61L 29/18; B61L 29/22

See application file for complete search history.

(56) References Cited

U.S. PATENT DOCUMENTS 9,150,229 B2 * 10/2015 Steffen ..... B61L 29/32

* cited by examiner

*Primary Examiner* — Robert J McCarry, Jr.
(74) *Attorney, Agent, or Firm* — Troutman Sanders LLP

(57) ABSTRACT

Controlling a level crossing of a railway track by providing a train having an onboard processor communicating with a wayside processor associated to a level crossing, said train having a forward end and a rear end; moving the train forward along the railway track lowering down gates of the level crossing when train is at a predetermined distance upon detection of the train approaching the level crossing; when the forward end passes over a first reference point defining the beginning of an island area of the level crossing, sending a first message from the onboard safety processor towards the wayside processor informing that the train is approaching the level crossing; maintaining down gates; when the rear end passes over a second reference point defining the end of the island area, sending a second message from the onboard safety processor to the wayside processor informing that the train has left the level crossing; and lifting the gates.

10 Claims, 3 Drawing Sheets

METHOD FOR CONTROLLING A LEVEL CROSSING AND RAILWAY INSTALLATION FOR IMPLEMENTING SUCH METHOD

FIELD OF THE INVENTION

The present invention relates to a method for controlling a level crossing of a railway track and to a railway installation for implementing such method.

BACKGROUND

A level crossing is an intersection where a railway line crosses a road or path at the same level, as opposed to railway line crossings using bridges or tunnels. The safety of level crossings is one of the most important issues of railways services. Each year about 400 people in the European Union and over 300 in the United States are killed in level crossing accidents. Collisions can occur with vehicles as well as pedestrians. Pedestrian collisions are more likely to result in death.

As far as warning systems for road users are concerned, standard level crossings have either passive protections in the form of different types of warning signs, or active protections, using automatic warning devices such as flashing lights, warning tones and boom gates. Fewer collisions take place at level crossings with active warning systems.

Recently, railroad companies have started to control level crossings through wireless control systems of the trains (e.g. PTC, ETCS, etc.), because this approach provides many benefits.

In these systems, a signal is wirelessly sent from a control unit of the train towards a control unit associated to the level crossing, thus allowing the latter to properly control the opening or closing of bars or gates placed in correspondence of the level crossing and arranged to prevent the crossing of the level crossing by vehicles or pedestrians present on the intersecting road or path.

This way of controlling the level crossings allows operations to be performed at speeds higher than the traditional activation through track circuits.

Level crossings operated through track circuits activate the crossing based either on initial occupancy of a section of track, or on detection of motion in any section of a track, or on prediction of arrival time based on changes in the electrical impedance of a track measured between the level crossing and a lead axle of the train.

All these track circuit methods have physical limitations as to how far from the crossing they can detect the train.

If a minimum amount of warning time is required for correctly closing the bars of a level crossing, then there is an upper limit to the maximum speed of the train at which track circuits can effectively and timely provide this warning time.

Wireless activation also enables constant warning prediction in areas where it was not previously possible, e.g. electrified rails, areas of poor shunting, etc.

In some cases, railroad companies have considered to completely eliminate the activation of level crossing through track circuits and to operate them, namely the bars present in correspondence of level crossings, through wireless activation only.

In fact, track circuits used to operate the bars represent a big expense for companies as they require constant adjustment and maintenance, and numerous train delays occur due to poor operation in harsh environmental conditions or when the track wires are damaged by the track maintenance equipment.

While the wireless level crossing activation potentially enables the elimination of the track circuits, an island track circuit is still required to keep the bars down when a train occupies a short area of a railway track placed on both sides of a road. In fact, a track circuit controlled level crossing generally has two different track circuits: an approach circuit and an island circuit.

The approach track circuit is a long distance circuit looking for the initial approach of the train, for the purpose of activating the warning devices. Any activation of the warning devices from the approach track circuit may be cleared if the train stops short of the crossing (for those track circuits that are able to detect motion).

The island track circuit is a short distance circuit, that keeps the warning devices activated any time this circuit is occupied by any portion of the train.

The main drawback of these existing circuits is that they require both constant adjustment and maintenance, and a wired connection to the rails, which is commonly damaged by track maintenance equipment.

As a result, the train movements are restricted until these wired connections are repaired and the level crossing equipment is tested and restored.

There is therefore the need to replace such island track circuits with a solution that is capable of providing a SIL-4 train detection (Safety Integrity Level), with a reliability equivalent to the one of the solution based on the island track circuits but that, on the other side, does not require wires attached to the rails or equipment in the fouling zone of track maintenance equipment, wherein a fouling zone is an area where track maintenance equipment may damage devices of the railway track.

SUMMARY

An object of the present invention is therefore to provide a method for controlling a level crossing of a railway track which is capable of detecting the presence of a train on the railway track itself, without the need of wires attached to the rails, thus enabling safe operation of bars placed in correspondence of the level crossing by overcoming the limitations of the prior art systems.

This and other objectives are achieved by a method for controlling a level crossing of a railway track having the characteristics defined in the examples below, and by a railway installation having the characteristics described below.

Particular examples of the invention are the subject of the dependent claims, whose content is to be understood as an integral or integrating part of the present description.

BRIEF DESCRIPTION OF THE DRAWINGS

Further characteristics and advantages of the present invention will become apparent from the following description, provided merely by way of a non-limiting example, with reference to the enclosed drawings, in which.

DETAILED DESCRIPTION

Briefly, the method of the present invention is based on the exchange of messages between onboard and wayside safety processors to detect the presence of a train in an island area, this wayside safety processors being usually placed in a shelter adjacent to a level crossing. The solution uses the wireless train control system already existing between trains and wayside control units for exchanging signals for the activation of bars of the level crossing. The method requires that the onboard safety processor knows the location of the front and the rear ends of the train, and this can be accomplished by any location determination system (e.g. GPS, beacons, cab signals, etc.).

Figure 1:
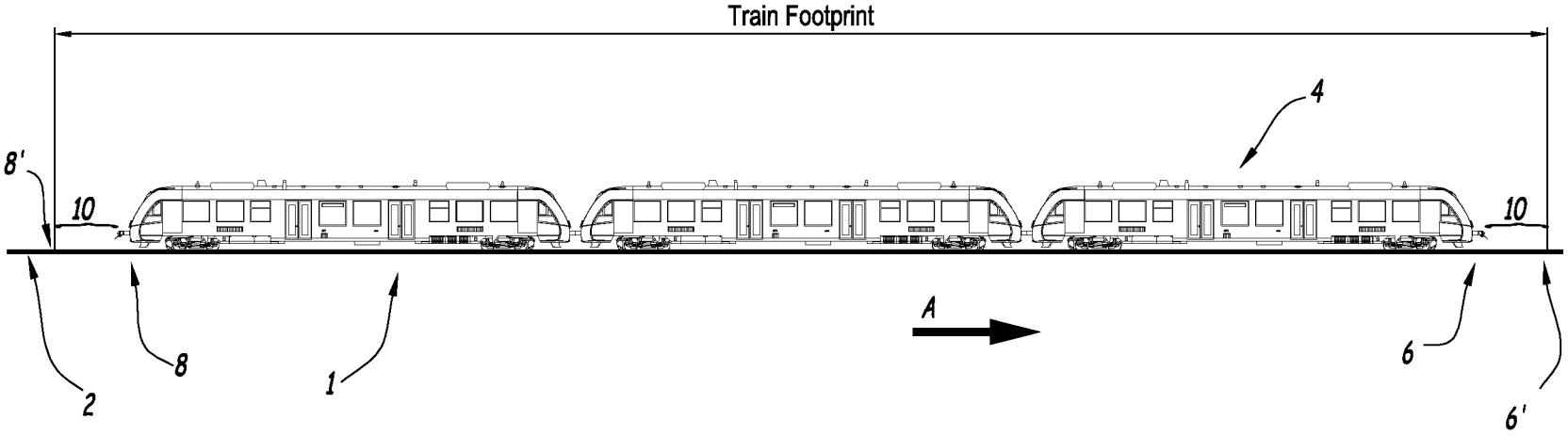
FIG. 1 shows a schematic lateral view of a train on a railway track.

FIG. 1 shows a schematic lateral view of a train 1 on a railway track 2 provided with an onboard safety processor 4 arranged to determine, in a manner known per se, a WCA (worst case ahead) point 6 and a WCB (worst case behind) 8 for the train 1. The WCA point 6 and WCB point 8 respectively define the two ends of the train 1, and a portion of the railway track 2 comprised between the WCA point 6 and the WCB point 8 corresponds to an area of occupancy of the train 1 on the railway track 2.

In a preferred embodiment, a safety space 10 is added respectively after the WCA point 6 and before the WCB point 8, thus obtaining respective updated WCA point 6' and updated WCB point 8' to get a safer enlarged area of occupancy of the train 1 on the railway track 2.

Advantageously, the railway track 2 is devoid of island track circuit and preferably also of approach track circuit. The approach track circuit being replaced, for example, by the use of the wireless train control system, a signal being wirelessly sent from the onboard safety processor 4 towards a control unit associated to the level crossing, thus allowing the latter to properly control the opening or closing of bars or gates placed in correspondence of the level crossing.

Figure 2:
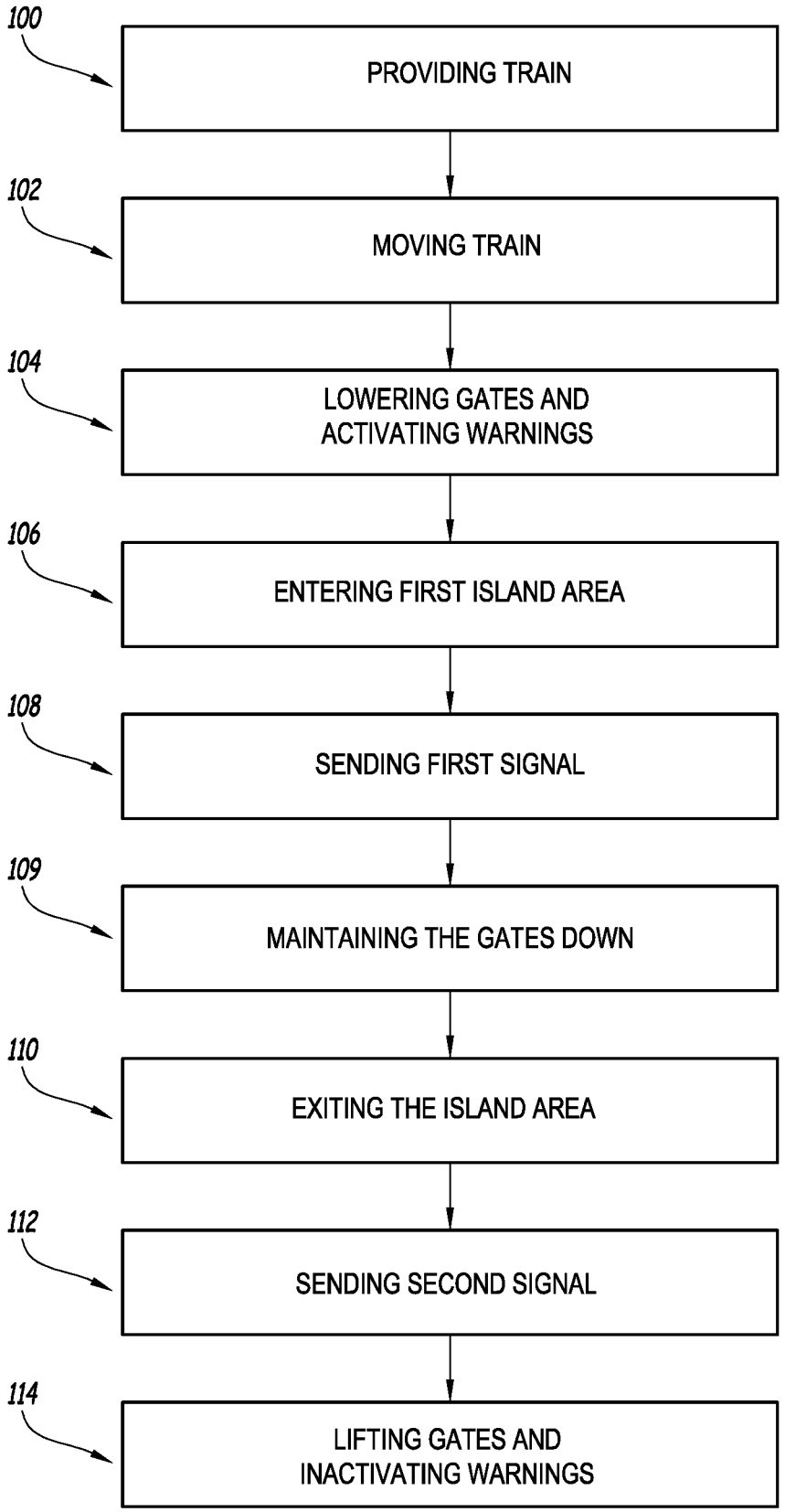
FIG. 2 shows a block diagram of the steps of a method for controlling a level crossing of a railway track according to the present invention.

In the following, a method for controlling a level crossing of a railway track according to the present invention is disclosed in detail, with reference to FIG. 2, which shows a block diagram of the steps of such a method.

In a first step 100, a train of the type above disclosed is provided. Then, in step 102, the train 1 is moved forward along the railway track 2 in a direction A, so that the WCA point 6 and WCB point 8 move correspondingly along the railway track 2 in the same direction A.

Subsequently, at step 104, a wayside processor, not shown in the figures, lowers down the gates of a level crossing, and preferably activates warning devices, upon detection, in a manner known per se, of the approach of the train 1 to the level crossing. For example, the gates are lowered when the train is a predetermined distance from the level crossing.

Subsequently, at step 106, the WCA point 6 enters in a first island area placed along the railway track 2, as herein below disclosed. Then, at step 108 the onboard safety processor 4 sends to the wayside safety processor a first signal or message informing that the train 1 is approaching a corresponding level crossing.

The island area is a portion of the railway track 2 placed in correspondence of a level crossing and is defined as the portion of the railway track 2 placed between respectively a first and a second reference point of said railway track 2, the first reference point being the first one along the direction A. The positions of said reference points are stored in a database onboard the train 1, which contains the positions of all the island areas present along the railway track 2.

In step 106, therefore, the WCA point 6 passes over the first reference point during the movement of the train in the direction A.

The train 1 continues its movement on the railway track 2 in the direction A, and the gates at step 109 are maintained down, until, at step 110, the train 1 exits the island area, in particular, the WCB point 8 passes over the second reference point.

At subsequent step 112 the onboard safety processor 4 sends to the wayside safety processor a second signal or message informing that the train 1 has left the corresponding level crossing.

At this point, at step 114, the wayside safety processor lifts the crossing gates and inactivates the warning devices.

Specific messages, preferably with acknowledgements, are used to perform these operations, as disclosed herein below.

Figure 3:
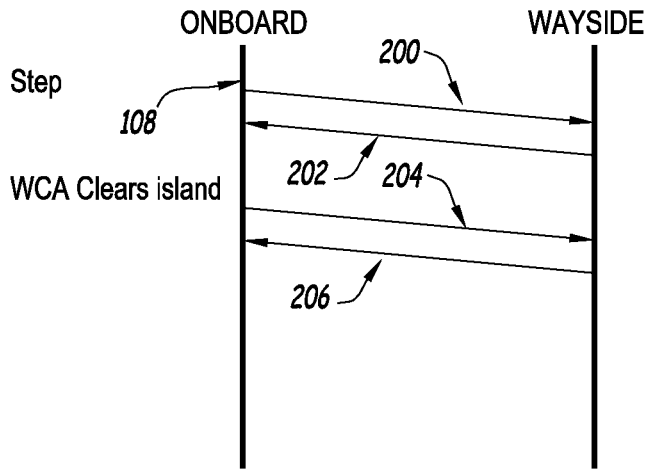
FIG. 3 shows a schematic graphic of the messages exchanged between an onboard processor and a wayside processor.
Figure 4:
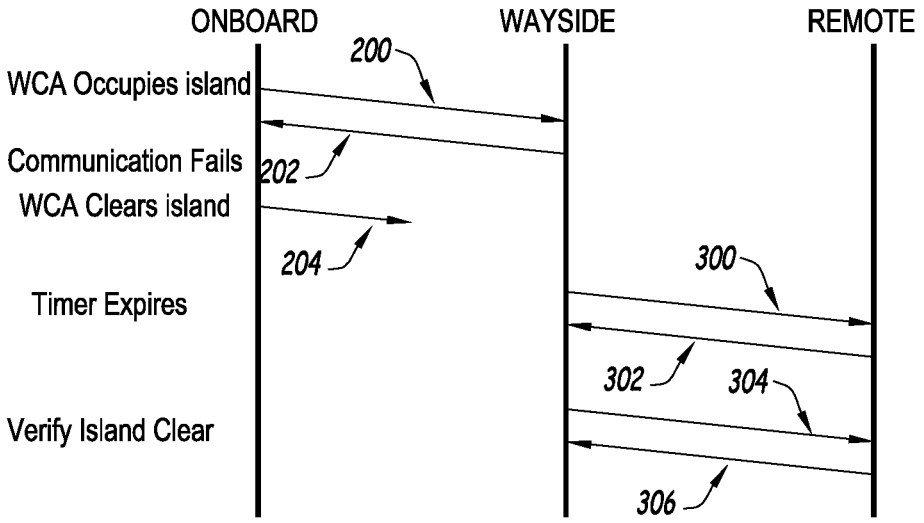
FIG. 4 shows a schematic graphic of alternatives messages exchanged between the onboard processor and the wayside processor of FIG. 3.

FIGS. 3 and 4 shows a schematic graphic of the messages exchanged between the onboard processor 4 and the wayside processor.

An island occupancy message 200, corresponding to the first message, is sent from the onboard safety processor 4 to the wayside processor at step 108, this island occupancy message 200 including an expected time value which represents the time instant $t_8$ at which it is expected that the WCB point 8 will pass over the second reference point, based on current speed of the train 1. This allows the wayside safety processor to foresee when to expect the second message from the onboard processor 4 informing that the train 1 has left the corresponding level crossing, this being done as a safety measure in case of failure of the communication system.

Advantageously, after the reception of the island occupancy message 200, an island occupancy acknowledgment message 202 is immediately sent back from the wayside processor to the onboard processor 4 to confirm correct receipt of the message 200.

At step 112, an island cleared message 204 is sent from the onboard processor 4 to the wayside processor, and a corresponding island cleared acknowledgment message 206 is in turn preferably sent back.

The dispatch of the island occupancy message 200 allows the onboard processor 4 to send also an updated time value $t'_8$ to the wayside processor in case the train 1 significantly slows down or stops after it has occupied the island. In particular, an updated occupancy message 200, which contains the updated time value $t'_8$, is sent to the wayside processor.

If the expected time expires before the wayside processor has received from the onboard processor 4 the island cleared message 204, this means that the communications system may have failed. In this case, the wayside processor continues to keep the crossing gates down and the warning devices active but, as shown in FIG. 4, it sends also a false activation message 300 to a remote control unit notifying that the crossing may be falsely activated. A corresponding false activation acknowledgement message 302 is sent back from the remote control unit and the wayside processor.

This allows performing a further verification about the real occupancy of the level crossing, for example by sending an operator on the site or by activating a video-surveillance etc.

In a preferred embodiment of the invention, the remote control unit sends a release crossing message 304 to the wayside processor to allow it to lift the gates. This release crossing message 304 is sent after confirmation that the train 1 has actually left the island area, and this could be done by local or remote surveillance known per se. The wayside processor sends in turn a release crossing acknowledgement message 306.

In an alternative embodiment, an auxiliary backup train detection system such as infrared, radar, video, etc. is placed at the crossing in case of communication failures.

The present invention relates also to a railway installation comprising the railway track 2, the level crossing placed along said railway track 2 and the train 1, wherein the wayside processor and the onboard processor are arranged to cooperate so as to implement the method above disclosed.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A method for controlling a level crossing of a railway track comprising at least the following steps of:

providing a train having an onboard processor arranged to determine a forward end and a rear end of the train by using a location determination system and to communicate with a wayside processor associated to a level crossing, said train extending between said forward end and said rear end;

moving the train forward along the railway track in a predetermined direction so that the forward end and the rear end move correspondingly along the railway track in the same direction;

lowering down gates of the level crossing upon detection of the train approaching the level crossing based on the actual location of the train;

when the forward end passes over a first reference point defining the beginning of an island area associated to the level crossing, sending a first message from the onboard safety processor towards the wayside processor to inform that the train is approaching the corresponding level crossing;

maintaining down gates of the level crossing;

when the rear end passes over a second reference point defining the end of the island area, sending a second message from the onboard safety processor to the wayside processor to inform that the train has left the corresponding level crossing; and lifting the gates of the level crossing.

2. The method of claim 1, further comprising, after the step of sending a first message, a step of sending an acknowledgment message from the wayside processor to the onboard processor.

3. The method of claim 1, further comprising, after the step of sending a second message, a step of sending an acknowledgement message from the wayside processor to the onboard processor.

4. The method of claim 1, further comprising a step of sending, together with the first message, an expected time value which represents the time instant at which the second message is expected.

5. The method of claim 4, further comprising a step of sending to the wayside processor an updated time value in case the train slows down or stops after it enters in the island area.

6. The method of claim 4, further comprising, in case no second message is received within the expected time, a step of sending, from the wayside processor, a false activation message to a remote control unit notifying that the level crossing has been falsely activated.

7. The method of claim 6, further comprising a step of sending, from the remote control unit, a release crossing message to the wayside processor to allow it to lift the gates of the level crossing.

8. The method of claim 7, wherein the release crossing message is sent upon confirmation that the train has actually left the island area.

9. The method of claim 1, further comprising the step of providing an auxiliary backup train detection system at the level crossing in case of communication failures.

10. Railway installation comprising a railway track, a level crossing placed along said railway track, a train having an onboard processor arranged to move on said railway track towards the level crossing, and a wayside processor placed adjacent to said railway track, the wayside processor and the onboard processor being arranged to cooperate so as to implement a method according to claim 1.

* * * * *